US008511804B2

(12) United States Patent
Ma

(10) Patent No.: US 8,511,804 B2
(45) Date of Patent: Aug. 20, 2013

(54) INK CARTRIDGE FOR AN INK JET PRINTER

(75) Inventor: Haoming Ma, Guangdong (CN)

(73) Assignee: Zhuhai Ninestar Management Co., Ltd., Guangdong (CN)

( * ) Notice: Subject to any disclaimer, the term of this patent is extended or adjusted under 35 U.S.C. 154(b) by 303 days.

(21) Appl. No.: 13/009,154

(22) Filed: Jan. 19, 2011

(65) Prior Publication Data

US 2012/0182365 A1 Jul. 19, 2012

(51) Int. Cl.
*B41J 2/175* (2006.01)

(52) U.S. Cl.
USPC ..... 347/86; 128/202.14; 128/204.21; 347/7; 347/9; 347/37; 417/118; 137/493

(58) Field of Classification Search
None
See application file for complete search history.

(56) References Cited

U.S. PATENT DOCUMENTS 5,183,391 A * 2/1993 Fiedler ..... 417/118
5,736,992 A * 4/1998 Pawlowski, Jr. ..... 347/7
6,131,571 A * 10/2000 Lampotang et al. ..... 128/204.21
6,758,558 B2 * 7/2004 Chiu et al. ..... 347/86
6,793,329 B2 * 9/2004 Battey et al. ..... 347/86
6,905,199 B2 * 6/2005 Miyazawa et al. ..... 347/86
7,004,575 B2 * 2/2006 Inoue et al. ..... 347/86
2001/0006396 A1 * 7/2001 Iida ..... 347/86
2007/0115309 A1 * 5/2007 Miura et al. ..... 347/9

* cited by examiner

*Primary Examiner* — Matthew Luu
*Assistant Examiner* — John P Zimmermann
(74) *Attorney, Agent, or Firm* — J.C. Patents

(57) ABSTRACT

The invention relates to an ink cartridge for an ink jet printer. The ink cartridge comprises a cartridge body and a detection mechanism for detecting the ink cartridge and residual quantity of ink, wherein the cartridge body comprises an ink tank for storing ink, an ink outlet for supplying ink to a printing head of the printer and an air inlet, the ink tank comprises a first ink chamber and a second ink chamber, a first negative pressure mechanism and a second negative pressure mechanism are arranged between the first ink chamber and the second cavity, the first negative pressure mechanism and the second negative pressure mechanism cooperatively control the ink inside the first ink chamber to be consumed preferentially than the ink inside the second ink chamber, and the second negative pressure mechanism generates negative pressure when a certain quantity of ink inside the ink tank is used for printing. Since negative pressure inside the ink tank is not generated until the used ink inside the ink tank reaches a certain quantity, i.e., negative pressure is generated only in case that the residual quantity of ink is small in the end, the technical problem that constant negative pressure in the process of using the ink cartridge leads to the damage and deformation of the parts inside the ink cartridge which impact on the quality of printing can be avoided.

11 Claims, 6 Drawing Sheets

INK CARTRIDGE FOR AN INK JET PRINTER

FIELD OF THE TECHNOLOGY

The present invention relates to an ink cartridge for an ink jet printer.

BACKGROUND

The ink cartridges of conventional ink jet printers are all provided with a negative pressure mechanism which can generate negative pressure inside the ink cartridge. However, negative pressure is generated from the beginning when the ink cartridge is used for printing and is constantly maintained until the ink is used up. As a result, when the ink cartridge is under the state of negative pressure for a long time, the ink of a printing head can be easily sucked out to damage the printing head and further affect printing quality.

Another kind of ink jet printer adopts the design of non-shaft-type ink supply. A replaceable ink cartridge of such an ink jet printer is positioned below a printing head. The ink is pumped by a suction pump into an irreplaceable ink cartridge above the printing head, which is connected with a nozzle, and the ink is maintained by a negative pressure mechanism. The replaceable ink cartridge of such an ink jet printer only plays a role of accommodating the ink. However, this replaceable ink cartridge is a constant pressure structure, the quantity of ink is detected by a buoy inside the replaceable ink cartridge, and the buoy, due to its own weight, is incapable to detect the quantity of ink accurately when the quantity of ink is small. Therefore, the following function is configured in the program of the printer: when a sheltering part on the other side of the buoy can no longer be detected, the printer prompts the depletion of the ink after printing another 2-3 ML of ink according to an internal counting device.

Based on this function of the printer, a replaceable ink cartridge with an ink bag (as shown in FIG. 1) has been invented for use with such printer. Such an ink cartridge has no air-conducting passage so as not to contact with the air. However, since the demand of detecting the depletion of the ink of the printer needs to be met, the ink bag of the ink cartridge is divided into two parts with one being used cooperatively for detection and the other one being used for accommodating the ink, and the two parts communicate with each other. In order to meet the demand of installation detection of the ink cartridge, the ink bag for detection is sealed by a silica gel film. Due to the different sealing materials of the two parts of the ink bag, which are seldom completely identical to each other in density, toughness and the like, the reflection for suction force is difficult to control, thereby often resulting in that the ink bag for accommodating the ink firstly shrivels and the ink bag for detection then shrivels. In this case, the quantity of ink inside the ink cartridge is less than 2 ml when the detection component detects the depletion of the ink. As a result, the problems about insufficient supply of ink at printing port and burnout of the printing head are generated.

SUMMARY

The invention provides an ink cartridge for an ink jet printer, in order to solve the technical problem that constant negative pressure in the process of using the ink cartridge leads to the damage and deformation of the parts inside the ink cartridge which affects printing quality.

In order to solve the technical problem above, one aspect of the present invention provides an ink cartridge for an ink jet printer. The ink cartridge comprises a cartridge body and a detection mechanism for detecting the ink cartridge and the residual quantity of ink, wherein the cartridge body comprises an ink tank for storing ink, an ink outlet for supplying ink to a printing head of the printer and an air inlet, the ink tank comprises a first ink chamber and a second ink chamber, a first negative pressure mechanism is arranged between the first ink chamber and the second ink chamber, the ink cartridge is characterized in that a second negative pressure mechanism is further arranged between the first ink chamber and the second ink chamber, the first negative pressure mechanism and the second negative pressure mechanism cooperatively control the ink inside the first ink chamber to be consumed preferentially than the ink inside the second ink chamber, and the second negative pressure mechanism generates negative pressure only when a certain quantity of ink inside the ink tank is reached.

The first negative pressure mechanism may be a gravity valve and the second negative pressure mechanism may be a buoyancy valve.

The gravity valve comprises a gravity valve base and a gravity valve core with a density higher than that of the ink.

The buoyancy valve may comprise a buoyancy valve base and a buoyancy valve core with a density lower than that of the ink.

The detection mechanism for detecting the ink cartridge and the residual quantity of ink comprises a first detection component cooperative with a first sensor on the printer, a second detection component cooperative with a second sensor on the printer and a soft support cap communicating with the second ink chamber on the cartridge body, the second detection component comprises a movable rod member and a fixed shaft arranged at the cartridge body, the movable rod member is rotatably connected with the cartridge body through the fixed shaft, the soft support cap is positioned at a corresponding position where the movable rod member droops under gravity and comes into contact with the movable rod member when a position adjusting member of the movable rod member overtakes the soft support cap.

The front wall of the cartridge body, on which the ink outlet is arranged, is provided with an elastic component, one end of the elastic component is fixedly connected with a front wall of the cartridge body, the other end of the elastic component is capable of reach the wall of an accommodation space of the ink cartridge of the printer by bending the elastic component, the elastic component is provided with a support position, and the movable rod member is supported by the support position on the elastic component.

A negative pressure value under control of the gravity valve is larger than a collapsing resistance value of the soft support cap.

The support position is an opening formed on the elastic component.

The front wall of the cartridge body, on which the ink outlet is arranged, is provided with a clamping position, and one end of the elastic component is fixedly connected with the cartridge body through the clamping position.

According to the technical solution described above, as the ink tank is internally provided with a second negative pressure mechanism, the second negative pressure mechanism generates negative pressure when a certain quantity of ink inside the ink tank is used for printing, and negative pressure inside the ink tank is not generated until the used ink inside the ink tank reaches a certain quantity, i.e., negative pressure is generated only in case that the residual quantity of ink is small in the end, therefore the technical problem that constant negative pressure in the process of using the ink cartridge leads to the damage and deformation of the parts inside the ink cartridge which impact on printing quality can be avoided. In addition, more accurate control is achieved by adopting the soft support cap for warning about the residual quantity of ink, and the manufacturing technology is simple. Finally, since the space for buoy is saved, more ink can be accommodated, thereby saving printing cost of users.

Figure 1:
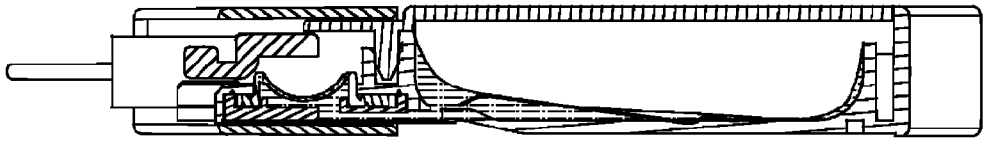
FIG. 1 is a schematic diagram of a conventional ink cartridge which may generate printing defects.

In the Figures: 1 Ink cartridge 2 air inlet 3 first detection component 4 elastic component 5 second detection component 6 soft support cap 7 ink outlet 8 buoyancy valve 9 gravity valve 10 ink cartridge housing 102 second sensor 104 first sensor 105 ink cartridge housing cap 61 flexible support film 62 communication passage 63 soft support cap sealing rib 81 buoyancy valve base 82 buoyancy valve core 811 valve core sealing portion 812 fluid passage 813 valve base sealing rib 91 gravity valve base 92 gravity valve core.

DETAILED DESCRIPTION

Figure 2:
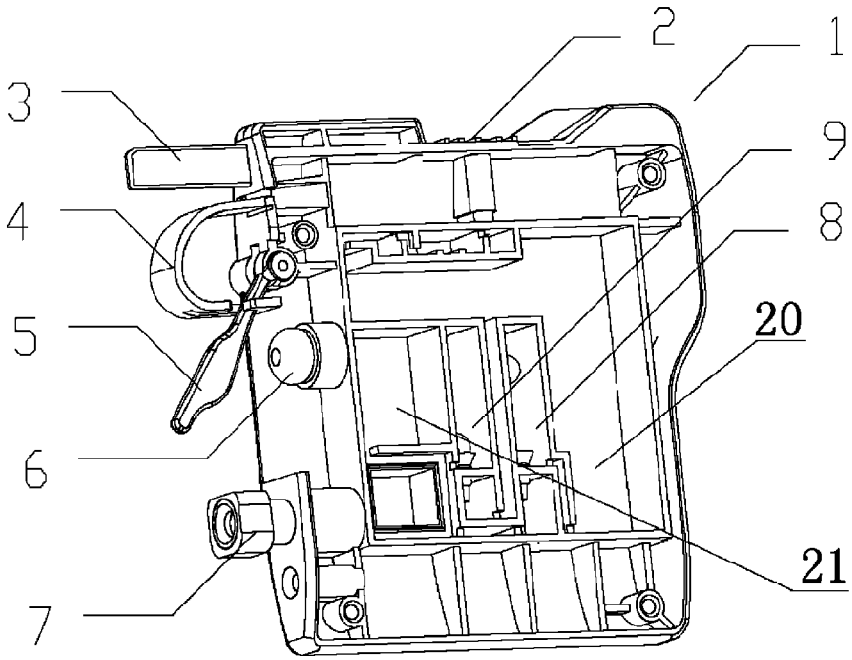
FIG. 2 is a schematic diagram of the ink cartridge according to an embodiment of the invention.

The ink cartridge for ink jet printer, as shown in FIG. 2, comprises a cartridge body 1 and a detection mechanism for detecting the ink cartridge and the residual quantity of ink. The cartridge body comprises an ink tank for storing ink, an ink outlet 7 for supplying ink to a printing head of the printer and an air inlet 2. The ink tank comprises a first ink chamber 20 and a second ink chamber 21, a gravity valve 9 and a buoyancy valve 8 are arranged between the first ink chamber 20 and the second ink chamber 21. The gravity valve 9 and the buoyancy valve 8 cooperatively control the ink inside the first ink chamber 20 to be used up preferentially than the ink inside the second ink chamber 21. By means of the buoyancy valve 8, a negative pressure is generated only when a certain quantity of ink inside the ink tank has been consumed for printing, and the air inlet 2 is arranged on the first ink chamber 20.

The detection mechanism for detecting the ink cartridge and the residual quantity of ink comprises a first detection component 3 cooperative with a first sensor on the printer, a second detection component 5 cooperative with a second sensor on the printer, and a soft support cap 6 communicating with the second ink chamber and provided on the cartridge body. The second detection component comprises a movable rod member 5 and a fixed shaft arranged at the cartridge body, the movable rod member is rotatably connected with the cartridge body through the fixed shaft. The soft support cap 6 is positioned at a corresponding position where the movable rod member droops under gravity, and comes into contact with the movable rod member when a position adjusting member of the movable rod member overtakes the soft support cap. A front wall of the cartridge body, on which the ink outlet is arranged, is also provided with an elastic component 4, one end of the elastic component 4 is fixedly connected with the front wall of the cartridge body, the other end of the elastic component 4 can contact a wall of an accommodation space of the ink cartridge by bending the elastic component 4. The elastic component 4 is provided with a support position, and the movable rod member is supported by the support position on the elastic component 4. The support position is an opening formed on the elastic component for receiving the removable rod member. The front wall of the cartridge body, on which the ink outlet is arranged, is provided with a clamping position, and one end of the elastic component is fixedly connected with the cartridge body through the clamping position.

The air outside the ink cartridge enters the cartridge body 1 through the air inlet. The ink outlet 7 plays a role of transferring the ink inside the ink cartridge 1 to the printing head of the printer.

Figure 8:
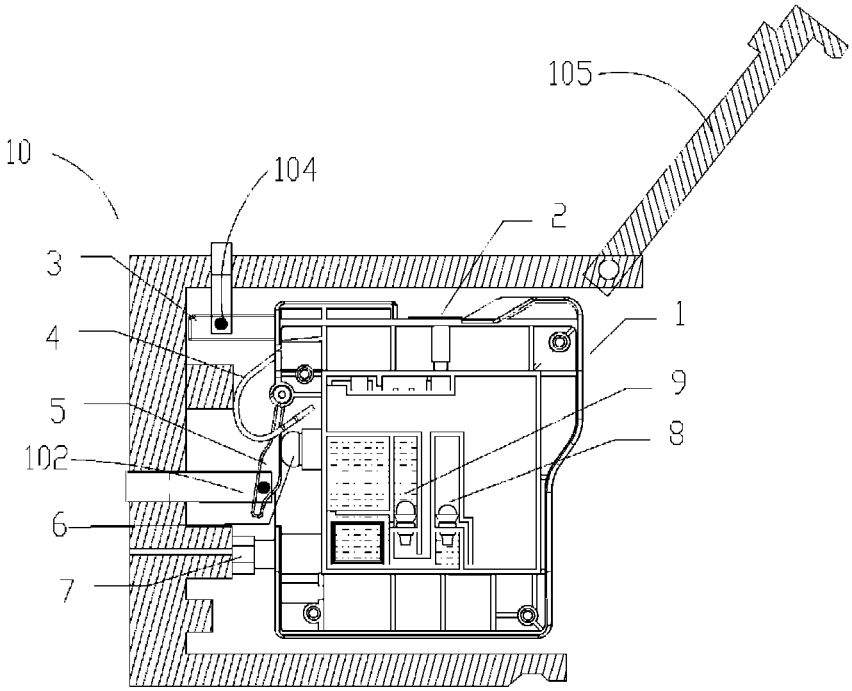
FIG. 8 is a schematic diagram of the installation of the ink cartridge provided by the invention.

The first detection component 3 performs the detection in cooperation with the first sensor 104 on the printer. After the ink cartridge is installed, the first detection component 3 blocks the light emitted from a light emitting portion of the first sensor 104, as shown in FIG. 8, so that a receiving portion of the first sensor 104 receives no light. After the detection in the printer in cooperation with the second detection component 5, successful installation detection of the ink cartridge is achieved.

The second detection component 5 performs the detection in cooperation with the second sensor 102 on the printer. After the ink cartridge is installed, the second detection component 5 blocks the light emitted from a light emitting portion of the second sensor 102, so that a receiving portion of the second sensor 102 receives no light. After the detection in the printer in cooperation with the first detection component 3, successful installation detection of the ink cartridge is achieved, as shown in FIG. 8.

The elastic component 4 plays a role in installation detection in cooperation with the second detection component. That is because the following states exist in the process of installing the ink cartridge into the printer:

In the beginning, two sensors 102 and 104 of the printer are under the state of switching-on. While the installation of the ink cartridge is performed, light is emitted from an emitting portion of the second sensor 102 and is blocked by the movable rod member 5 so as not to return to the receiving portion of the second sensor 102. Under this state the light path of the second sensor 102 is switched off, while the first sensor 104 which is not in contact with the first detection component 3 is under the state of switching-on.

Light is then emitted from the emitting portion of the second sensor 102, as the elastic component 4 comes into contact with the wall of the ink cartridge housing 10, the elastic component 4 undergoes displacement so as not to support the movable rod member 5 any more, and thus the movable rod member 5 rotates around the fixed shaft, and a displacement of the movable rod member 5 relative to a front arm of the ink cartridge 1 along an installation direction is larger than a length of the second sensor 102 along an installation direction. In this case, the detection position of the movable rod member 5 has passed by the sensing position of the second sensor 102, and the light is emitted to the receiving portion of the second sensor 102. Under this state, the light path of the second sensor 102 is switched on, while the light emitted from the emitting portion of the first sensor 104 is blocked by the first detection component 3, thus the light path of the first sensor 104 is under the state of switching-off.

Figure 4:
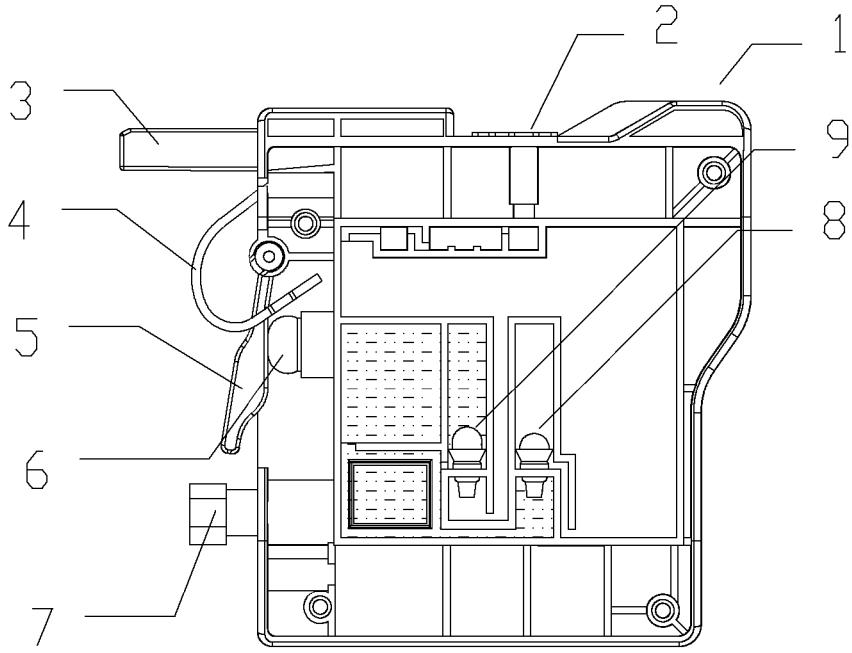
FIG. 4 is a schematic diagram of the state of the ink cartridge in case of sealing the buoyancy valve during printing.

As the ink cartridge is further pushed into the printer, light is emitted from the emitting portion of the second sensor 102, and the movable rod member 5 comes into contact with and is supported by the soft support cap 6 at its rear part, as shown in FIG. 4, and displacement of the movable rod member 5 stops, and now the movable rod member 5 is positioned at the detection position of the second sensor 102. In this case, the light emitted from the second sensor 102 is blocked by the movable rod member 5 so as not to return to the receiving portion of the second sensor 102. Under this state, the light path of the second sensor is switched off, and the light emitted from the emitting portion of the first sensor 104 is still blocked by the first detection component 3. Therefore, the light path of the first sensor 104 is also under the state of switching-off, and the ink inlet of the printer is cooperative with the ink outlet 7 of the ink cartridge and smooth ink supply is achieved.

Figure 3:
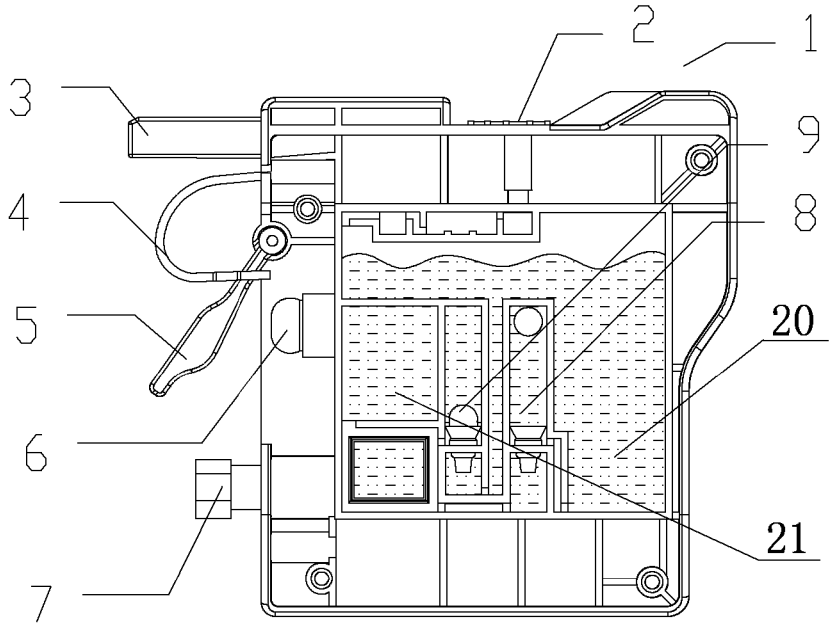
FIG. 3 is a schematic diagram of the state of the ink cartridge at the beginning of installing the ink cartridge into the printer.

During the initial state in the above installation process, as shown in FIG. 3, the elastic component 4 supports the movable rod member 5. When the movable rod member 5 passes by the detection position of the second sensor 102 once, the elastic component 4 does not support the movable rod member 5 any more. Afterwards, the movable rod member 5 is supported by the soft support cap 6. When the ink cartridge is removed from the printer, the elastic component 4 becomes to support the movable rod member 5 once again so that the movable rod member 5 returns to its original position so as to repeat the installation process above when reinstallation is required.

Figure 7:
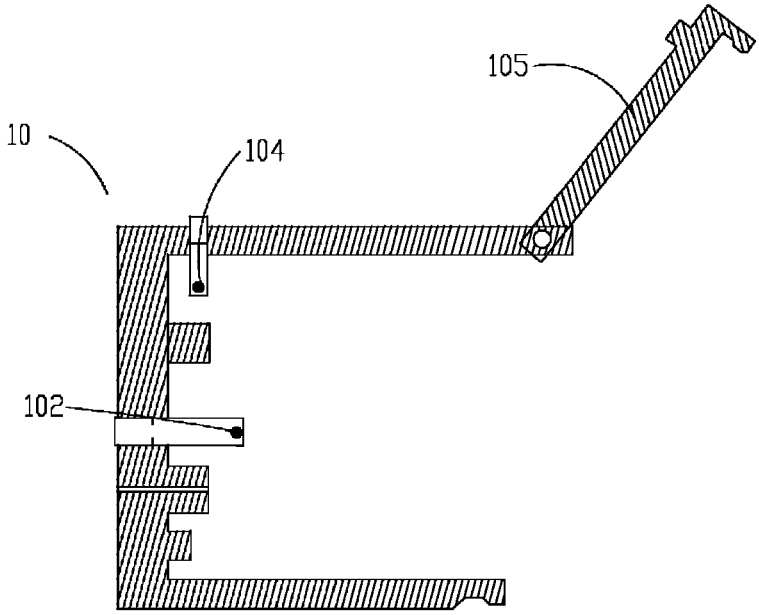
FIG. 7 is a schematic diagram of the cooperative ink cartridge housing.

The elastic component 4 plays another role of springing the ink cartridge away from the ink cartridge housing 10 when the ink cartridge is removed from the printer. This process is as below: when the ink cartridge is installed into the ink cartridge housing 10, as shown in FIG. 7, the elastic component 4 is deformed, and the deformed elastic component 4 cannot reset after the ink cartridge housing cap 105 is closed, thus the elastic component 4 resets to push the ink cartridge away from the ink cartridge housing when the ink cartridge housing cap 105 is opened.

The soft support cap 6 plays a role of supporting the movable rod member 5 after the ink cartridge is installed, so that the second detection component 5 is maintained at the detection position of the second sensor 102 to achieve successful installation detection, as shown in FIG. 8.

Figure 9A:
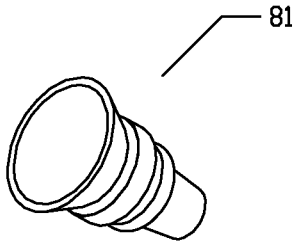
FIG. 9A is a schematic diagram of the buoyancy valve base and the gravity valve base inside the ink cartridge.
Figure 9C:
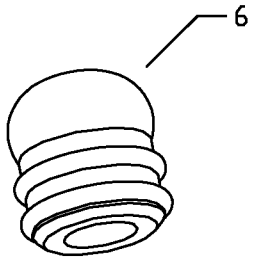
FIG. 9C is a schematic diagram of the soft support cap inside the ink cartridge.
Figure 9B:
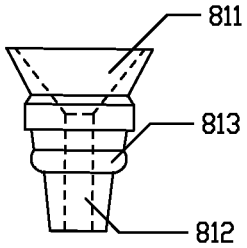
FIG. 9B is a sectional view of the buoyancy valve base and the gravity valve base inside the ink cartridge.
Figure 9D:
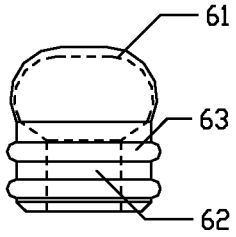
FIG. 9D is a sectional view of the soft support cap inside the ink cartridge.

The soft support cap 6, as shown in FIG. 9C, comprises: a flexible support film 61, which can support the movable rod member 5 and can collapse according to internal pressure change; a communication passage 62, which can be communicate with the ink chamber; and a soft support cap sealing rib 63, which can seal the ink chamber, as shown in FIG. 9D.

The soft support cap plays another role of cooperating with the ink depletion detection of the printer, and the ink depletion detection comprises the following process:

The quantity of ink continuously decreases as the printing is performed. When the ink inside the ink cartridge is used up, the flexible support film 61 of the flexible support cap 6, due to the adjustment of the buoyancy valve 8 and the gravity valve 9 inside the ink cartridge 1, collapses under the suction action of an ink supply needle of the printer when the ink is about to be used up. The flexible support cap 61 no longer supports the movable rod member 5 and the movable rod member 5 continues to move under gravity to be away from the position where the light path of the second sensor 102 is blocked. Light is directly emitted to a light receiving element. In this case, the first sensor 104 of the printer is blocked, while the second sensor 102 is not blocked, thus the printer prompts the ink will be used up and sends a signal to the user.

Figure 5:
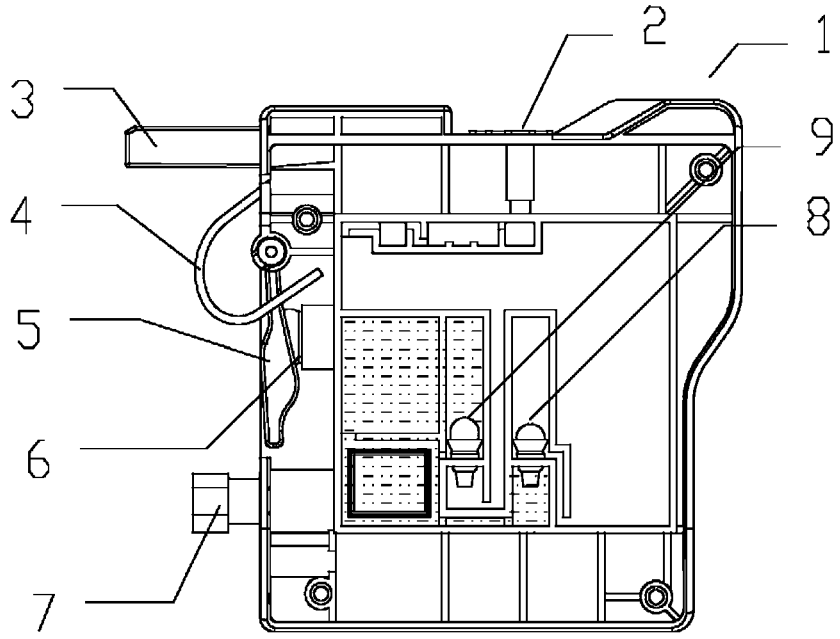
FIG. 5 is a schematic diagram of the collapsing state of the soft support cap of the invention.

The buoyancy valve 8 and the gravity valve 9 play the role of adjusting the pressure inside the ink cartridge, so that the soft support cap 6 is caused to collapse, as shown in FIG. 5, so as to further achieve the purpose of detecting ink depletion.

The buoyancy valve 8 comprises: a buoyancy valve base 81 as shown in FIG. 9A and a buoyancy valve core 82, wherein the buoyancy valve base 81 is characterized by a valve core sealing portion 811 cooperative with the buoyancy valve core 82, a fluid passage 812 for communicating the ink chamber with the ink outlet, and a valve base sealing rib 813 capable of fixing the valve base 81 and sealing the periphery of the valve base 81; the valve core 82 is characterized by having a density lower than that of the ink and being capable of sealing the fluid passage 812 in cooperation with the valve base sealing portion 811, as shown in FIG. 9B.

The gravity valve 9 comprises: a gravity valve base 91 and a gravity valve core 92, wherein the gravity valve base 91 includes the same structural characteristics as the buoyancy valve base 81; the valve core 92 is characterized by having a density higher than that of the ink and being capable of sealing the fluid passage under certain pressure (>−3 KPa) in cooperation with the valve base sealing portion, as shown in FIG. 8. A negative pressure value under the control of the gravity valve is larger than a collapsing resistance value of the soft support cap.

Figure 10:
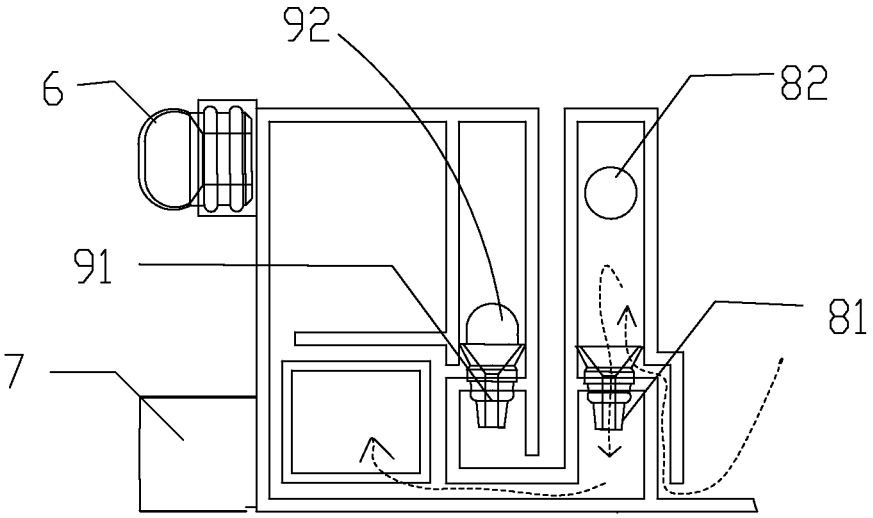
FIG. 10 is a schematic diagram of fluid flowing when the buoyancy valve base is opened and the gravity valve base is sealed.

The process of controlling the buoyancy valve 8 and the gravity valve 9 is as follows:

When the ink inside the ink cartridge is not used up, the buoyancy valve core 82 of the buoyancy base 8 floats above the ink due to the density thereof lower than that of the ink. The buoyancy valve 8 is under the state of opening, and the pressure inside the ink cartridge is the same as outside pressure. The gravity valve core 92 of the gravity valve 9, due to the density thereof higher than that of the ink, is cooperative with the valve base sealing portion so that the gravity valve is under the state of closing. The flowing path of the ink is shown as the dotted line in FIG. 10.

The level of the ink continuously descends as the ink is used for printing. By the time the buoyancy valve core 82 is cooperative with the valve base sealing portion, the buoyancy valve 8 is closed. Since the gravity valve 9 is also under the state of closing, the cavity adjacent to the ink outlet is under the state of sealing. Since the ink supply needle of the printer has certain suction force, thus printing is not influenced.

After both the buoyancy valve 8 and the gravity valve 9 are closed, the pressure of the ink chamber communicating with the soft support cap 6 gradually decreases as the ink is used for printing. When the pressure reaches certain value (−0.5 to −3 KPa), the flexible support film 61 of the soft support cap 6 is deformed so as not to support the second detection component 5 any more. In this case, the printer prompts the ink is about to be used up (2-3 ml of the ink remains inside the ink cartridge at this stage).

Figure 6:
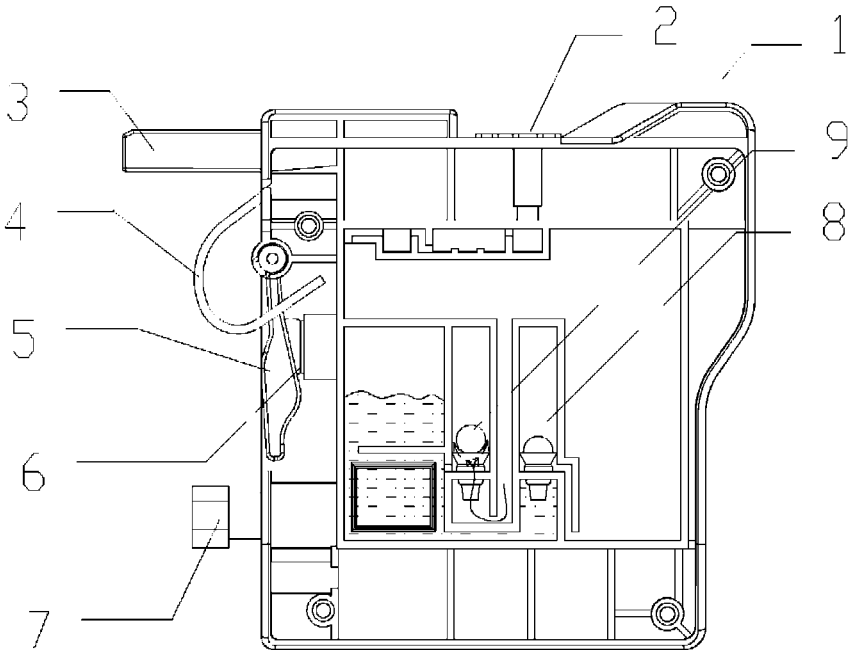
FIG. 6 is a schematic diagram of the state of the ink cartridge when the gravity valve is opened.
Figure 11:
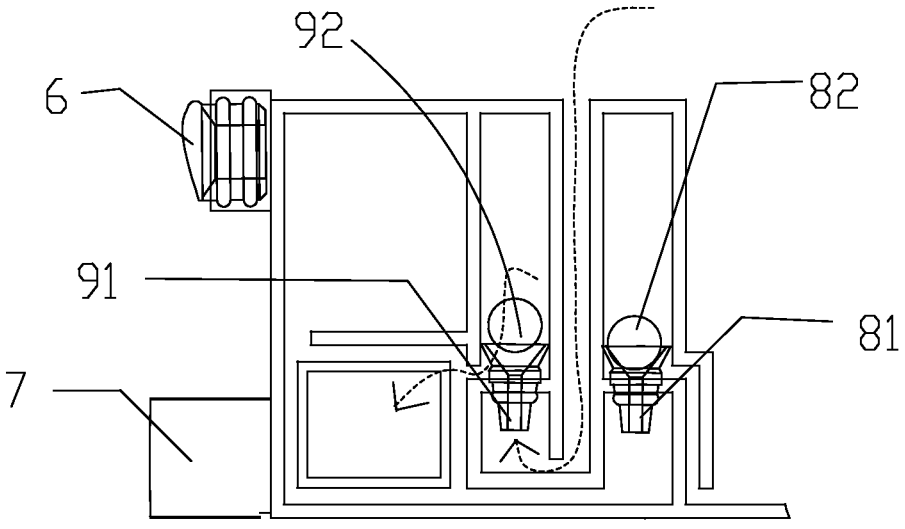
FIG. 11 is a schematic diagram of fluid flowing when the buoyancy valve base is sealed and the gravity valve base is opened.

After the situation that the ink is about to be used up is promoted, the ink supply needle of the printer still sucks the ink ceaselessly. When the pressure at the ink outlet reaches certain value (≦−3 KPa), the pressure generated by the pressure difference between atmosphere and interior of the cavity can overcome the gravity of the gravity valve core 92 of the gravity valve 9, thus the gravity valve core 92 moves away from the sealing position and the gravity valve 9 is opened. The air can enter through the fluid passage, and the ink chamber is communicated with the soft support cap 6, shown as FIG. 6. In this case, the fluid flows in a manner as shown in FIG. 11. When the pressure inside the cavity decreases, since the gravity valve 9 is opened, the pressure interior of the cavity is inclined to be identical with external pressure (because the pressure value is a negative value, the value decreases, e.g., the previous pressure value is −70 KP, while the present pressure value is −60 KP), the pressure generated by the pressure difference between atmosphere and interior of the cavity cannot overcome the gravity of the gravity valve core 92 of the gravity valve 9, thus the gravity valve core 92 returns to the sealing position once again, and the gravity valve 9 is closed once again. As the ink is used, the gravity valve 9 is opened and closed ceaselessly to balance the pressure inside the cavity until the ink is used up.

This negative pressure control manner with a high control precision can achieve accurate control of the pressure when the soft support cap 6 collapses, thereby ensuring the accuracy of ink depletion detection of the printer.

What is claimed is:

1. An ink cartridge for an ink jet printer, comprising a cartridge body and a detection mechanism for detecting installation of the ink cartridge and residual quantity of ink, wherein the cartridge body comprises an ink tank for storing ink, an ink outlet for supplying ink to a printing head of the printer and an air inlet, the ink tank comprises a first ink chamber and a second ink chamber, a first negative pressure mechanism is arranged between the first ink chamber and the second ink chamber, the ink cartridge is characterized in that a second negative pressure mechanism is further arranged between the first ink chamber and the second ink chamber, the first negative pressure mechanism and the second negative pressure mechanism cooperatively control the ink inside the first ink chamber to be consumed preferentially than the ink inside the second ink chamber, and the second negative pressure mechanism generates negative pressure in the second ink chamber by sealing the second ink chamber from the first ink chamber only when a certain quantity of ink inside the ink tank is reached;

wherein a front wall of the cartridge body, on which the ink outlet is arranged, is provided with an elastic component, one end of the elastic component is fixedly connected with the front wall of the cartridge body, the other end of the elastic component is capable of reach a wall of an accommodation space of the ink cartridge of the printer by bending the elastic component, the elastic component is provided with a support position, and a movable rod member is supported by the support position on the elastic component.

2. The ink cartridge for an ink jet printer according to claim 1, wherein the first negative pressure mechanism is a gravity valve and the second negative pressure mechanism is a buoyancy valve.

3. The ink cartridge for an ink jet printer according to claim 2, wherein the gravity valve comprises a gravity valve base and a gravity valve core with a density higher than that of the ink.

4. The ink cartridge for an ink jet printer according to claim 2, wherein the buoyancy valve comprises a buoyancy valve base and a buoyancy valve core with a density lower than that of the ink.

5. The ink cartridge for an ink jet printer according to claim 1, wherein the detection mechanism for detecting the ink cartridge and the residual quantity of ink comprises a first detection component cooperative with a first sensor on the printer, a second detection component cooperative with a second sensor on the printer and a soft support cap communicating with the second ink chamber on the cartridge body.

6. The ink cartridge for an ink jet printer according to claim 5, wherein a negative pressure value under control of a gravity valve is larger than a collapsing resistance value of the soft support cap.

7. The ink cartridge for an ink jet printer according to claim 1, wherein the support position is an opening formed on the elastic component.

8. The ink cartridge for an ink jet printer according to claim 1, wherein the front wall of the cartridge body, on which the ink outlet is arranged, is provided with a clamping position, and one end of the elastic component is fixedly connected with the cartridge body through the clamping position.

9. An ink cartridge for an ink jet printer, comprising a cartridge body and a detection mechanism for detecting the ink cartridge and residual quantity of ink, wherein the cartridge body comprises an ink tank for storing ink, an ink outlet for supplying ink to a printing head of the printer and an air inlet, the ink tank comprises a first ink chamber and a second ink chamber, a first negative pressure mechanism is arranged between the first ink chamber and the second ink chamber, the ink cartridge is characterized in that a second negative pressure mechanism is further arranged between the first ink chamber and the second ink chamber, the first negative pressure mechanism and the second negative pressure mechanism cooperatively control the ink inside the first ink chamber to be consumed preferentially than the ink inside the second ink chamber, and the second negative pressure mechanism generates negative pressure only when a certain quantity of ink inside the ink tank is reached;

wherein the detection mechanism for detecting the ink cartridge and the residual quantity of ink comprises a first detection component cooperative with a first sensor on the printer, a second detection component cooperative with a second sensor on the printer and a soft support cap communicating with the second ink chamber on the cartridge body, the second detection component comprises a movable rod member and a fixed shaft arranged at the cartridge body, the movable rod member is rotatably connected with the cartridge body through the fixed shaft, the soft support cap is positioned at a corresponding position where the movable rod member droops under gravity and comes into contact with the movable rod member when a position adjusting member of the movable rod member overtakes the soft support cap.

10. The ink cartridge for an ink jet printer according to claim 5, wherein the second detection component comprises the movable rod member and a fixed shaft arranged at the cartridge body, the movable rod member is rotatably connected with the cartridge body through the fixed shaft.

11. The ink cartridge for an ink jet printer according to claim 10, wherein the soft support cap is positioned at a corresponding position where the movable rod member droops under gravity and comes into contact with the movable rod member when a position adjusting member of the movable rod member overtakes the soft support cap.

* * * * *